US010816257B2

(12) United States Patent
Estill et al.

(10) Patent No.: US 10,816,257 B2
(45) Date of Patent: Oct. 27, 2020

(54) REFRIGERATION APPARATUS

(71) Applicant: Danby Products Limited, Guelph (CA)

(72) Inventors: Jim Estill, Guelph (CA); Gregory Allan Thomas Hall, Guelph (CA); Bryan Stuart Cunningham, Kitchener (CA); Dennis O'Brien, Guelph (CA)

(73) Assignee: DANBY PRODUCTS LIMITED, Guelph (CA)

( * ) Notice: Subject to any disclaimer, the term of this patent is extended or adjusted under 35 U.S.C. 154(b) by 245 days.

(21) Appl. No.: 15/284,634

(22) Filed: Oct. 4, 2016

(65) Prior Publication Data

US 2017/0102176 A1 Apr. 13, 2017

Related U.S. Application Data

(60) Provisional application No. 62/240,555, filed on Oct. 13, 2015.

(51) Int. Cl.

| | |
|---|---|
| ***F25D 11/00*** | (2006.01) |
| ***F25D 23/00*** | (2006.01) |
| ***F25D 23/02*** | (2006.01) |
| ***F25D 23/06*** | (2006.01) |
| ***F25D 29/00*** | (2006.01) |

(52) U.S. Cl.

CPC ..... *F25D 11/00* (2013.01); *F25D 23/006* (2013.01); *F25D 23/026* (2013.01); *F25D 23/063* (2013.01); *F25D 23/067* (2013.01); *F25D 29/005* (2013.01); *F25D 2201/14* (2013.01); *F25D 2323/061* (2013.01); *F25D 2400/10* (2013.01); *F25D 2400/32* (2013.01); *F25D 2400/38* (2013.01)

(58) Field of Classification Search

CPC .... F25D 23/026; F25D 23/063; F25D 23/067; F25D 2323/061; F25D 2400/32; F25D 2400/12

See application file for complete search history.

(56) References Cited

U.S. PATENT DOCUMENTS

| | | | | |
|---|---|---|---|---|
| 1,328,324 A * | 1/1920 | Gwyer | F25D 23/062 | 217/129 |
| 2,507,379 A * | 5/1950 | Morrison | F25D 15/00 | 137/318 |
| 2,521,604 A * | 9/1950 | Provost | A47K 10/12 | 211/16 |
| 2,605,617 A * | 8/1952 | Replogle | F25D 23/062 | 16/319 |

(Continued)

FOREIGN PATENT DOCUMENTS

EP 1739023 A1 * 1/2007 ..... B65D 19/385

*Primary Examiner* — Ana M Vazquez

(74) *Attorney, Agent, or Firm* — Ralph E. Jocke; Colin P. Cochran; Walker & Jocke

(57) ABSTRACT

A refrigeration apparatus (10) is configured to be shipped in generally flat boxes and assembled near a location of use. A plurality of enclosure panels (12) bound an interior area (15). A cover panel (18) including a door (22) closes a top of the interior area. A platform panel (30) including an evaporator (32) closes the interior area at an end opposed of the cover panel. The platform which includes heat transfer components is supported on a base (52) with casters (60) that facilitate the movement of the apparatus.

27 Claims, 7 Drawing Sheets

(56) References Cited

U.S. PATENT DOCUMENTS

| | | | | | |
|---|---|---|---|---|---|
| 2,915,884 | A * | 12/1959 | Haushalter | A47F 3/0443 | 62/237 |
| 3,153,918 | A * | 10/1964 | Fink | F25D 11/00 | 312/290 |
| 4,809,851 | A * | 3/1989 | Oestreich, Jr. | B65D 7/32 | 206/511 |
| 4,898,004 | A * | 2/1990 | Richardson | A47F 3/0408 | 62/255 |
| 4,917,256 | A * | 4/1990 | Kruck | B29C 44/146 | 206/545 |
| 4,953,362 | A * | 9/1990 | Shoji | A47F 3/005 | 312/116 |
| 6,460,955 | B1 * | 10/2002 | Vaughan | B29C 51/267 | 312/236 |
| 7,451,603 | B2 * | 11/2008 | Tuszkiewicz | A47F 3/0408 | 62/291 |
| 7,496,956 | B1 * | 2/2009 | Viljoen | G06F 21/54 | 709/244 |
| 8,621,877 | B2 * | 1/2014 | Tuszkiewicz | A47F 3/0426 | 62/259.1 |
| 2010/0175599 | A1 * | 7/2010 | Ossorguine | A47B 7/02 | 108/183 |
| 2013/0276465 | A1 * | 10/2013 | Shin | F25B 21/02 | 62/3.6 |
| 2014/0216098 | A1 * | 8/2014 | Heinrich | F25D 19/02 | 62/419 |

* cited by examiner

REFRIGERATION APPARATUS

TECHNICAL FIELD

Exemplary embodiments relate to refrigeration apparatus such as refrigerators or freezers. A specific exemplary embodiment relates to a refrigeration apparatus that can be shipped in one or more flat boxes and assembled on site without tools or the need for special training.

BACKGROUND

Refrigeration apparatus are useful for keeping food and other items below ambient temperatures. Refrigeration apparatus are traditionally shipped fully assembled and are ready to run upon being removed from their packaging. The size of the packaging generally corresponds to the internal refrigerated area of the device in which items may be stored.

Refrigeration apparatus may benefit from improvements.

SUMMARY OF THE DISCLOSURE

Exemplary embodiments relate to a refrigeration apparatus that includes a number of different components. The exemplary arrangement enables the components to be shipped in one or more generally flat boxes. The components can then be assembled once they reach their destination without the use of special skills or tools. The exemplary arrangement reduces the volume of what must be shipped as well as reduces packaging costs. The exemplary arrangement is also economical and energy efficient. Numerous different configurations can also be made using the principles described. Repair and relocation is also simplified for exemplary embodiments.

DETAILED DESCRIPTION

Figure 1:
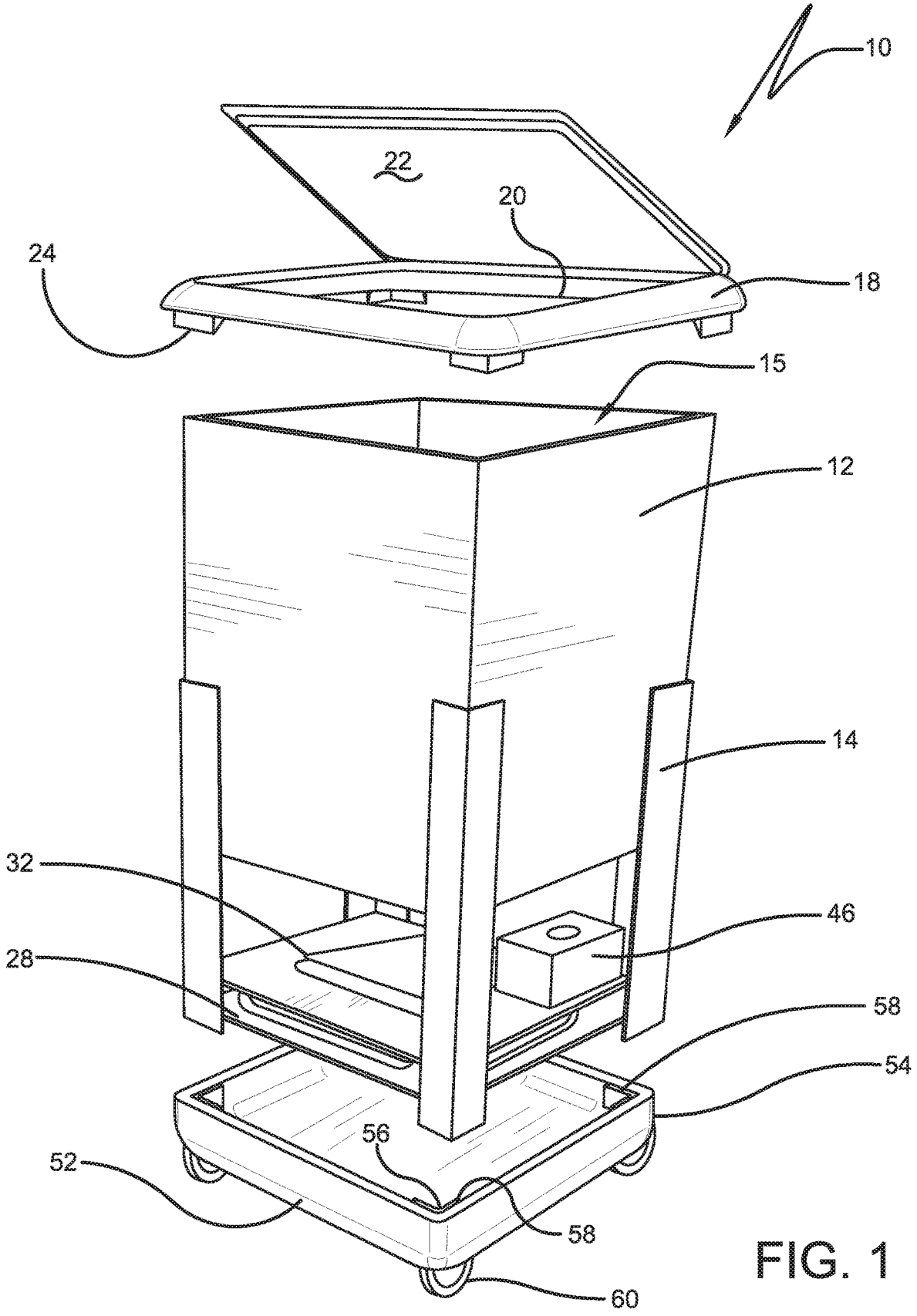
FIG. 1 is an isometric exploded view of a refrigeration apparatus of an exemplary embodiment.

Referring now to the drawings and particularly to FIG. 1, there is shown therein an exemplary embodiment of a refrigeration apparatus generally indicated 10. The exemplary refrigeration apparatus comprises a freezer used for holding food items or other items at a temperature substantially below ambient temperature. Of course it should be understood that other embodiments may comprise a refrigeration apparatus which houses items at temperatures below ambient but above freezing, a combined refrigerator freezer apparatus or other apparatus suitable for holding items at a controlled temperature below ambient. For purposes hereof, all such items may also be referred to herein as a refrigerator.

The exemplary embodiment is comprised of a plurality of separable enclosure panels 12. The enclosure panels 12 are configured to be enabled to be joined together to form a refrigerator enclosure. When assembled together, the separable enclosure panels bound the refrigerated interior area 15. In the exemplary arrangement, four separable enclosure panels are utilized to form the walls of the enclosure. However, it should be understood that in other embodiments other types and numbers of enclosure panels may be used.

In the exemplary embodiment, the enclosure panels are comprised of panels having a generally evacuated area in between inner and outer walls. The evacuated area provides resistance to heat transfer through the walls. Such walls may be comprised of plastic or other materials that further reduce heat transfer. In other arrangements, the enclosure panels may be comprised of other materials such as structural foam, fibrous material or other suitable materials that provide suitable resistance to heat transfer. Other exemplary arrangements may include panels that are combinations of such materials. For example the panel faces bounding the interior area may be configured to be smoother and more suitable for cleaning whereas the external surfaces may have different features or aesthetic features to make them more attractive. Different materials may also be used for internal and external surfaces. Further it should be understood that in exemplary arrangements the surfaces of the panels facing the interior area may include projections, recesses or other suitable mounting structures for shelves, drawers or other devices for holding the items to be stored therein.

Figure 7:
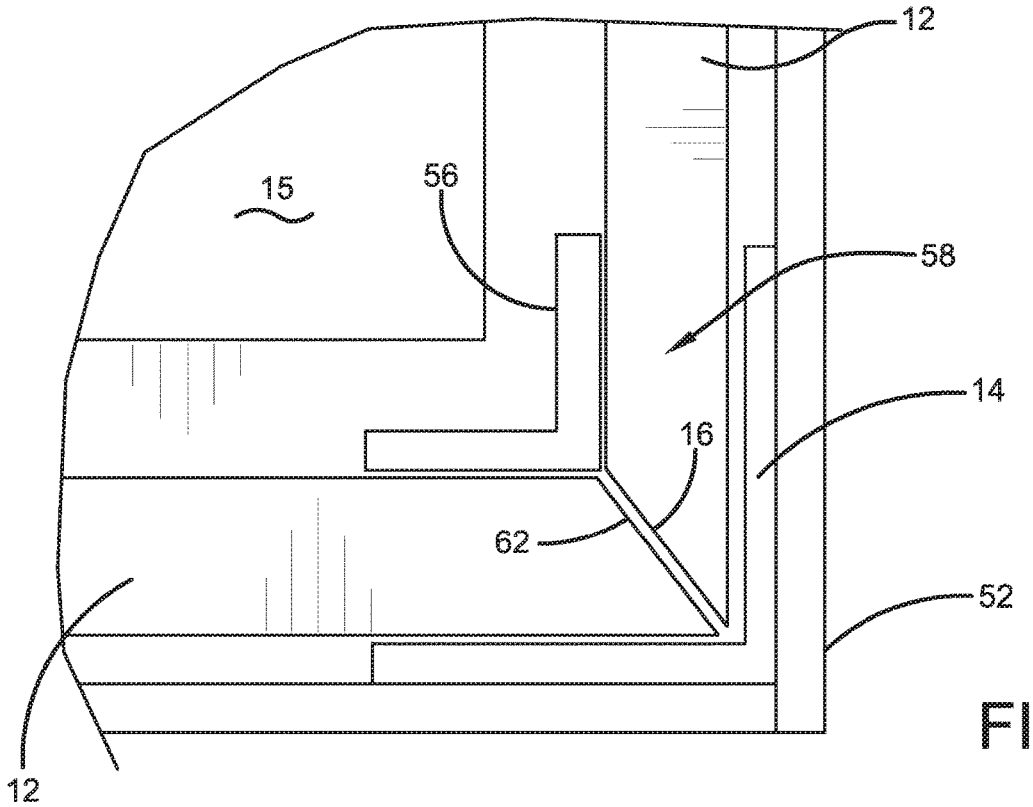
FIG. 7 is a top view of an exemplary base corner of the refrigeration apparatus.

In the exemplary arrangement, the refrigeration apparatus includes a plurality of corner posts 14. In the exemplary arrangement the corner posts 14 comprise posts that have a 90° angled structure. The exemplary corner posts are sufficiently long to span the separable enclosure panels 12. As represented in FIG. 7, the exemplary corner posts 14 are configured to overlie joints 16 at the corners where the enclosure panels are in very close adjacent or abutting relation. The exemplary corner posts have an angled configuration and are sufficiently rigid to hold the separable enclosure panels in engaged relation when the apparatus is assembled. The corner posts 14 also have sufficient length so as to engage structures at their opposed ends so as to further facilitate the assembly and holding of the refrigeration apparatus structure together.

As represented in FIG. 1, the exemplary embodiment includes a cover panel 18. In the exemplary arrangement, the cover panel overlies the top of the interior area 15. The exemplary cover panel includes a cover opening 20. The cover opening 20 is selectively closable by a movable door 22. The exemplary cover panel 18 is made of suitable plastic or other insulating material so as to minimize the loss of heat transfer through the cover panel and door when the door is in its closed position. Exemplary arrangements may include magnets or other suitable latching mechanism that may be utilized to hold the door 22 in the position closing the opening. A handle structure may be attached to or molded into the cover panel 18 so as to facilitate manually opening and closing the door when desired. Of course it should be understood that these structures are exemplary and in other embodiments, other approaches may be used.

Figure 6:
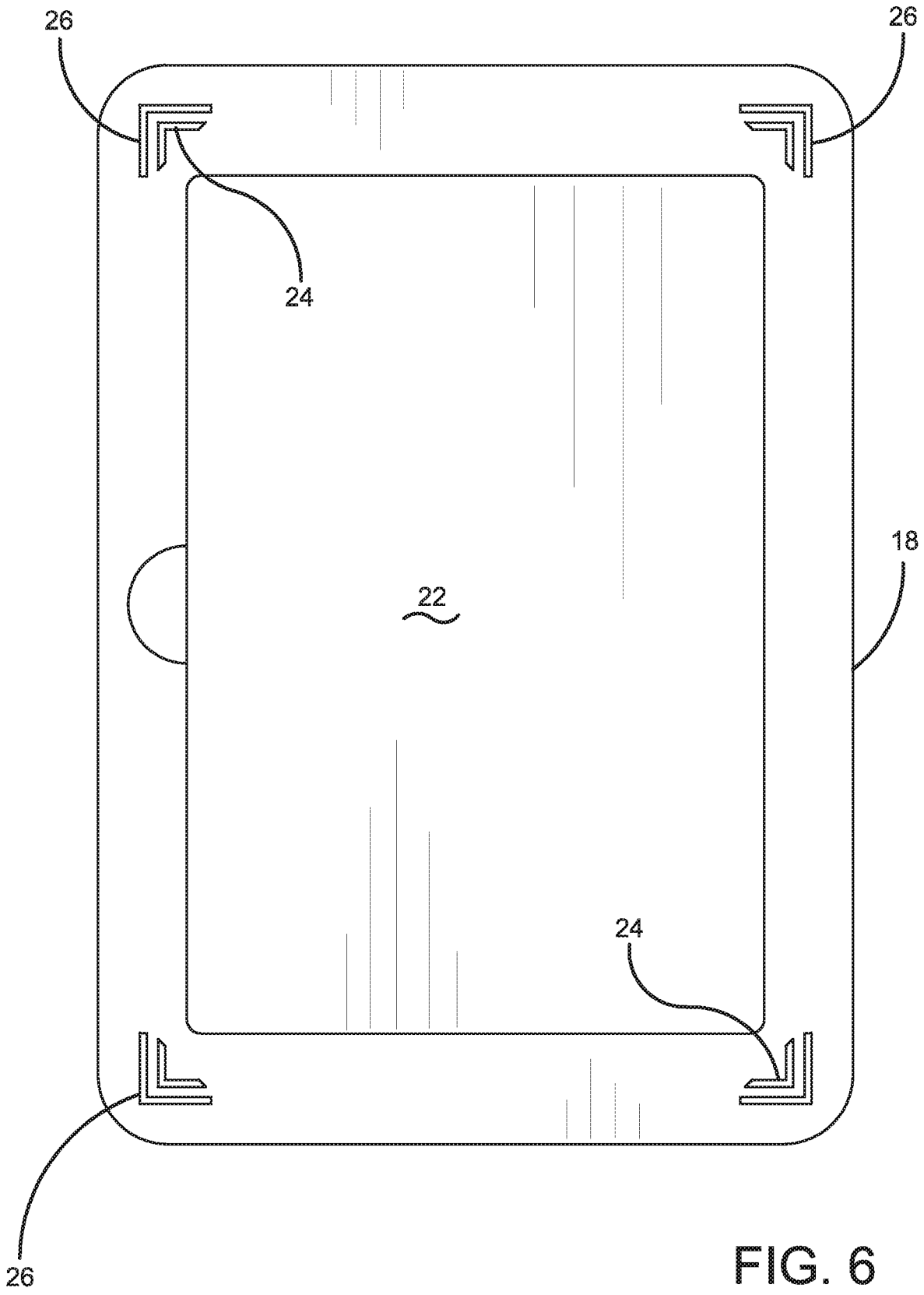
FIG. 6 is a bottom view of an exemplary cover panel used in an exemplary embodiment.

In the exemplary embodiment the cover panel 18 includes a plurality of cover projections 24. As represented in FIG. 6 which is a bottom view of the cover panel, the cover projections are positioned at the corners of the enclosure. The cover projections 24 are configured to inwardly overlie the joints 16 where the panels are in close or abutting relation when the enclosure is assembled. In the exemplary arrangement, the cover projections facilitate maintaining the positions and integrity of the enclosure panels as the panels extend between the overlying corner posts and underlying panel projections. Further in the exemplary arrangement, the cover panel includes cover pockets 26. The exemplary cover pockets 26 comprise apertures positioned at each of the corners and are configured to receive therein the upper portions of the corner posts 14. In the exemplary arrangement when the corner posts are received in the respective cover pockets 26, the enclosure panels are positioned between the cover projections 24 and the corner posts 14 in sandwiched relation. Further the exemplary arrangement provides for two enclosure panels to be positioned intermediate of the corner posts and cover projections at each corner. Further in some exemplary embodiments the cover projections, surfaces bounding corner pockets and/or corner posts may include tapers, ribs, barbs or other structural configurations that help to resist separation of the components once they have been joined together in engaged relation. Of course these approaches are exemplary and in other embodiments, other approaches may be used.

Figure 5:
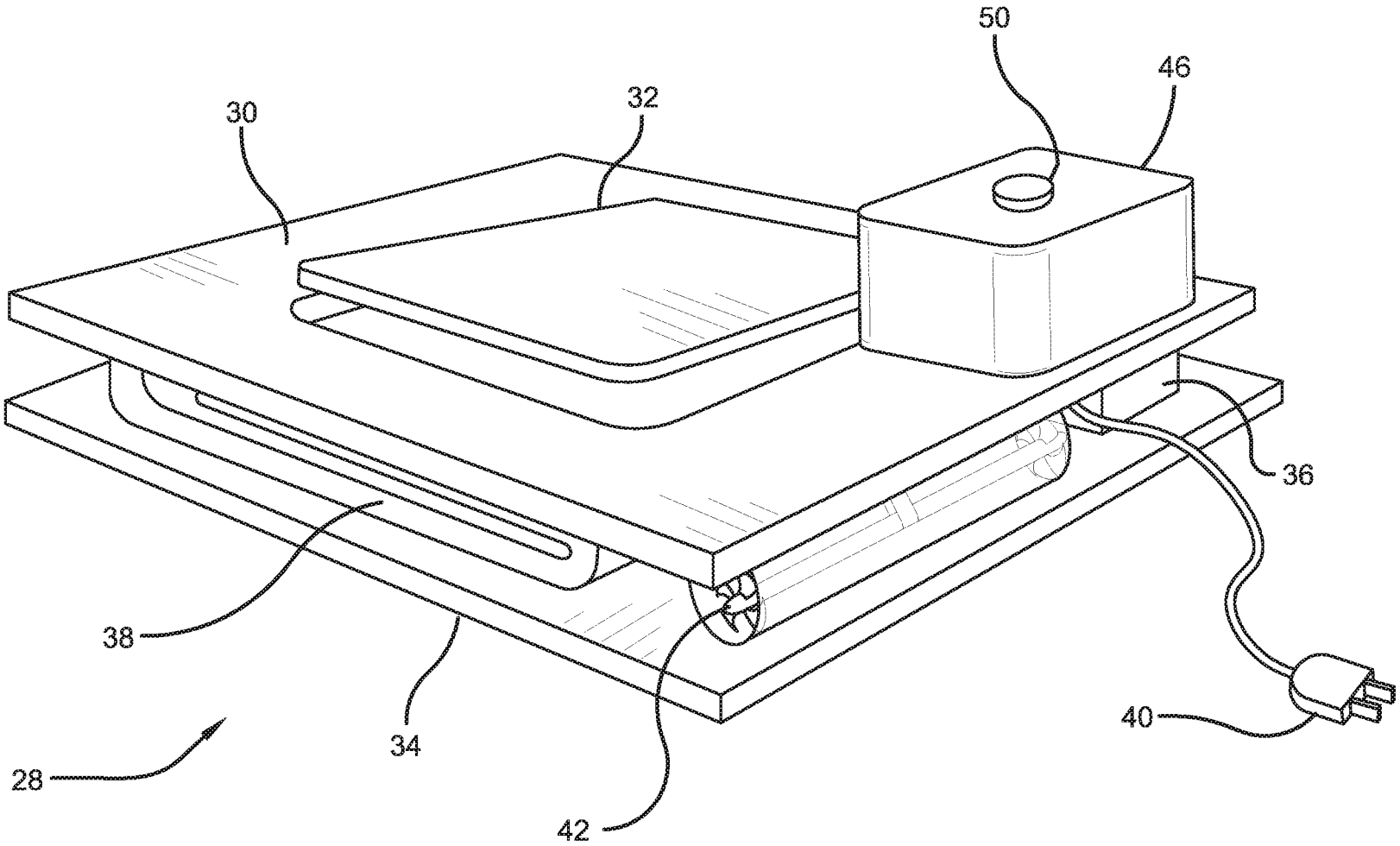
FIG. 5 is an isometric schematic view of a heat transfer platform used in an exemplary embodiment.

The exemplary refrigeration apparatus 10 further includes a heat transfer platform 28. The exemplary heat transfer platform includes components that operate to remove heat from the interior area 15 and cause the removed heat to be dissipated to outside the interior area. The exemplary platform which is shown in greater detail in FIG. 5 includes a rectangular platform panel 30. Platform panel 30 is configured to close the interior area 15 on a side opposed of the cover panel 18. The platform panel 30 has in supported connection therewith, a refrigerant evaporator 32. The refrigerant evaporator 32 is configured to fluidly conduct refrigerant material that changes from a liquid to a vapor phase therein and absorbs heat from the interior area of the apparatus. The exemplary arrangement includes a suitable cover for the evaporator 32 so as to avoid a puncture thereof by materials housed in the interior area. Further in exemplary arrangements, suitable structures are provided to enable air flow within the interior area and over the coils or other surfaces or features of the evaporator so as to facilitate the heat transfer effect achieved by the evaporator in the interior area. The exemplary platform panel 30 is also comprised of suitable insulating material such as those materials previously discussed so as to reduce the heat transfer into the interior area 15 of the enclosure.

Figure 8:
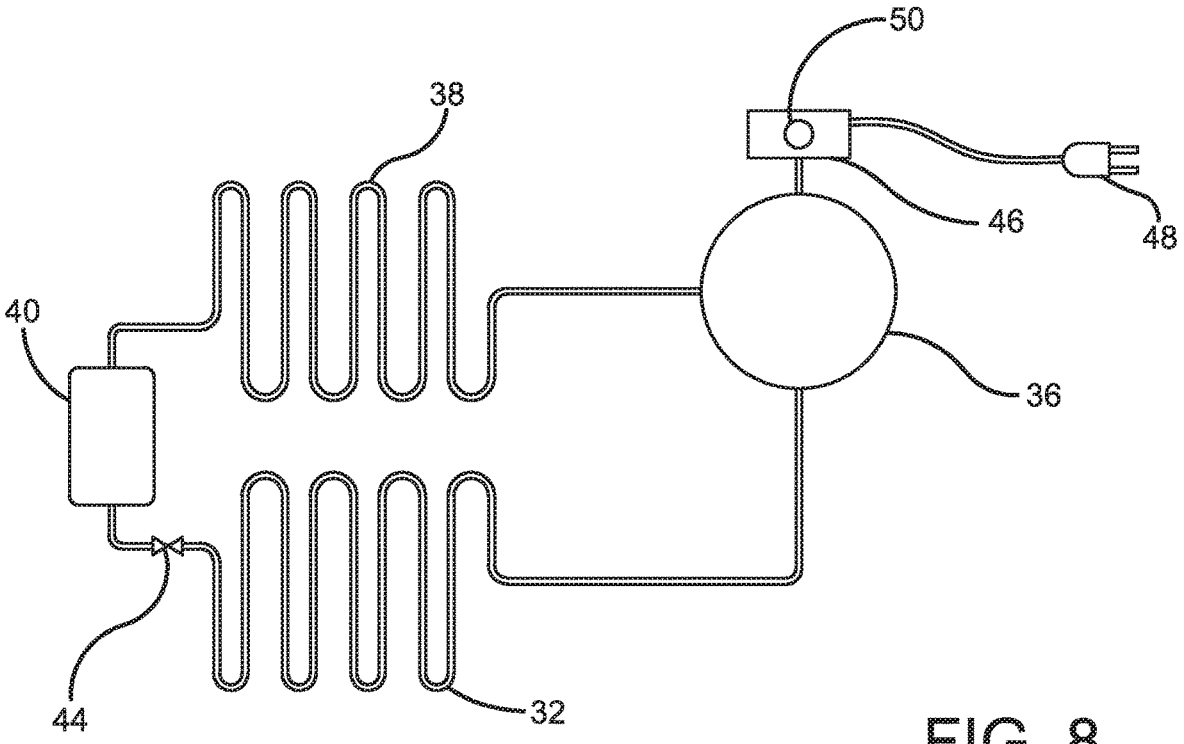
FIG. 8 is a schematic view of the platform components of an exemplary embodiment.

The exemplary platform 28 includes a further panel 34. Further panel 34 is disposed from panel 30 by suitable spacers, fasteners or other structures. Panel 34 has in operatively supported connection therewith, a refrigerant compressor 36 which is shown schematically in FIG. 8. The compressor 36 is in fluid connection with the evaporator 32 and is operative to compress and move the refrigerant through a condenser 38. The condenser 38 which in the exemplary arrangement extends between the panels 30 and 34, is operative to release heat from the refrigerant material and to cause the refrigerant material to return to a liquid state in which it can be collected in an accumulator 40. A fan 42 is operative to provide forced air flow through the coils, fin tubes or other heat transfer structures of the condenser so as to facilitate the release of heat therefrom and the change in phase of the refrigerant material from the vapor to a liquid therein. In the exemplary arrangement, the fan 42 comprises a centrifugal fan which is operative to cause air to flow between the panels 30 and 34 of the platform. Of course it should be understood that this approach is exemplary and in other embodiments, other approaches may be used.

In the exemplary arrangement the refrigerant material that is condensed to a liquid and held in the accumulator is returned to the evaporator 32 to complete the cooling cycle. An expansion valve 44 or other suitable structures are used to facilitate the dispersal of the refrigerant material and facilitate the operation of the evaporator 32. Of course it should be understood that these components are exemplary and are shown schematically in FIG. 8, and that other or additional components may be included in the heat transfer devices of other embodiments. Such structures may include, for example, filter dryers, fluid connectors, additional evaporator coils, additional accumulator coils and other suitable structures. Further it should be understood that while in the exemplary arrangement the platform structure is configured to be in operative supporting connection with all of the items included in the heat transfer circuit for the refrigeration apparatus, in other arrangements such components may be housed in additional or separate components. Further it should be understood that while the exemplary embodiment is described as utilizing a working fluid that undergoes a change in phase to provide cooling, other embodiments may utilize other types of cooling methods, for example an electronic cooling device. The electronic cooling device may include a Peltier device having a cooling panel face on the side of the platform that faces the interior area. Suitable circuitry may be provided to power the Peltier device and to control its cooling function.

In the exemplary arrangement, a power controller 46 is in operative connection with the compressor 36. The exemplary power controller 46 is configured to be connected to a suitable source of electrical power such as via a cord and plug 48. In exemplary embodiments, the plug may be configured for connection to a suitable source of household current such as 110 or 220 volts AC. However, in other embodiments exemplary arrangements may be suitable for connection to other power sources such as a battery power source, or a solar power source. The particular source of electrical power for operation of the platform 28 will depend on the environment in which the refrigeration apparatus is configured to be used.

In the exemplary arrangement the power controller 46 is in operative connection with the panel 30 and includes at least a portion thereof within the interior area 15 of the enclosure. In an exemplary arrangement a thermometer associated with the power controller 46 is positioned within the interior area so as to facilitate controlling the temperature therein. In some exemplary arrangements the power controller may further include a suitable input device such as a knob 50 which can be used to manually adjust the temperature within the enclosure. In exemplary arrangements the thermometer may include a thermocouple, bimetallic spring, expansive fluid chamber or other suitable detecting arrangement that can be used to determine the temperature in the area to which the thermometer is exposed. The adjusting knob can be used with appropriate circuitry in operative connection with the thermometer so as to deliver electrical power to the compressor 36 so as to provide additional cooling when needed to maintain the desired temperature. The power controller may also operate to cause power to be shut off to the compressor when the interior area is sufficiently cool.

In exemplary embodiments the power controller may include other suitable circuitry to facilitate operation of the refrigeration apparatus. This may include, for example, ground fault sensors, brownout detectors, lightning arresters, electrical short detectors or other suitable circuitry so as to detect adverse conditions and protect the compressor and other components from such adverse conditions which may cause damage thereto. Further in some exemplary arrangements, the input device for making adjustments to settings for the power controller device may be externally accessible so as to enable the setting of temperature within the interior area without the need for access thereto. Of course it should be understood that these approaches are exemplary and in other embodiments other arrangement may be used.

In the exemplary embodiment, the platform 28 is configured to be bounded by the four corner posts 14. In some arrangements, the configuration of the panels 30, 34 may be such that the interior surfaces of the corner posts hold the platform in a suitable lateral position so as to prevent the movement thereof relative to the other enclosure panels. Of course it should be understood that in other arrangements, other types of corner panels and structures may be utilized for purposes of positioning and holding the platform and other components of the apparatus as necessary to achieve the assembly and holding thereof in an operative position.

In the exemplary arrangement, the refrigeration apparatus further includes a rectangular base 52. The rectangular base 52 includes corners 54. The base corners 54 are configured so as to enable the corner posts 14 to extend therein. The base 52 further includes base projections 56. The base projections 56 bound L-shaped base pockets 58 at each corner of the base. As shown in FIG. 7, the exemplary base projections 56 are configured to enable each of two panels 12 to extend in intermediate relation between the projection and the corner post 54. Each projection 56 inwardly overlies two of the panels and the joint 16 therebetween so as to facilitate holding the structures in engaged relation. Further in exemplary arrangements the projections 56, corner posts 15 and interior surfaces of the base corners 54 may include tapers, projections, barbs or other suitable structures to facilitate holding the adjacent structures in engagement once they have been assembled. The projections 56 may also support the panel 34 of platform 28. Of course these approaches are exemplary and in other embodiments, other approaches may be used.

In the exemplary arrangement, a plurality of casters 60 are releasibly mounted to the base 52. The exemplary casters are usable to facilitate having the refrigeration apparatus be movable once it is assembled. In the exemplary arrangement, the casters are releasibly mounted to the base by extending posts which extend from the casters into openings in the base. Of course these approaches are exemplary and in other embodiments, other approaches may be used.

As represented in FIG. 7, the exemplary separable enclosure panels 12 have angled edges 62 which are configured to provide an angled mitered structure at each of the joints 16 where the panels are in adjacent relation. This angled structure for the edges 62 are configured to enable the sequential assembly of the panels into the structure and to reduce the infiltration of air and heat into the refrigerated interior area 15. It should be understood, however, that other edge structures may be utilized in connection with the panels so as to form joints which serve the purposes of enabling assembly and reducing the infiltration of heat. For example, in some arrangements the edges may be stepped or have other tongue and groove-like configurations so as to enable the panels to be joined together. Such arrangements may provide additional rigidity to the structure and may enable the elimination of the corner posts or supporting projections in the base and cover. In other arrangements, corner structures may be utilized which enable accepting panels therein and which enable the panel edges to be flat or another convenient configuration which can be engaged with the separate corner structures which bound the corners of the enclosure. Of course numerous different approaches may be used in other embodiments.

Figure 2:
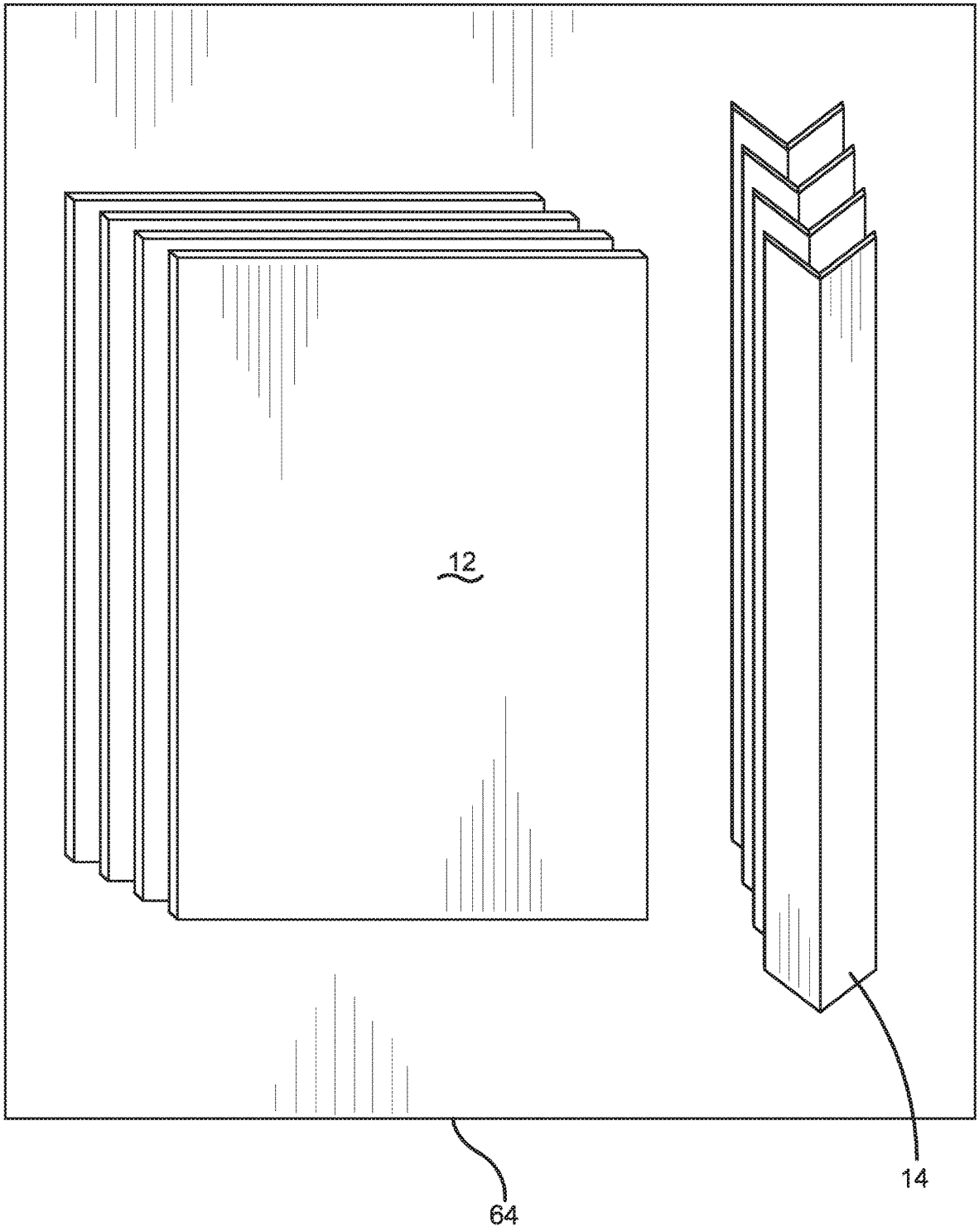
FIGS. 2-4 are views of exemplary components of the refrigeration apparatus of FIG. 1 and their packaging.
Figure 3:
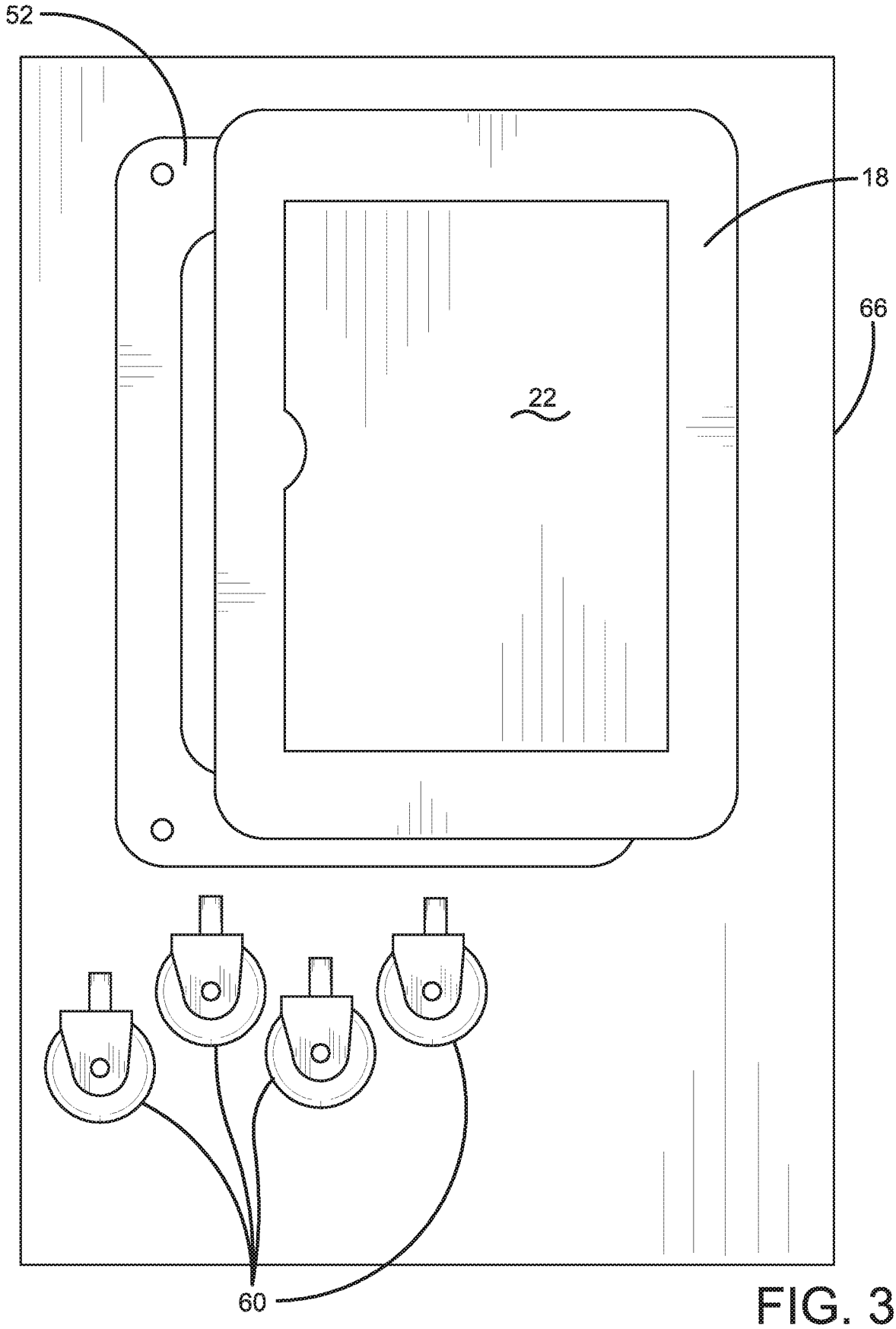
Figure 4:
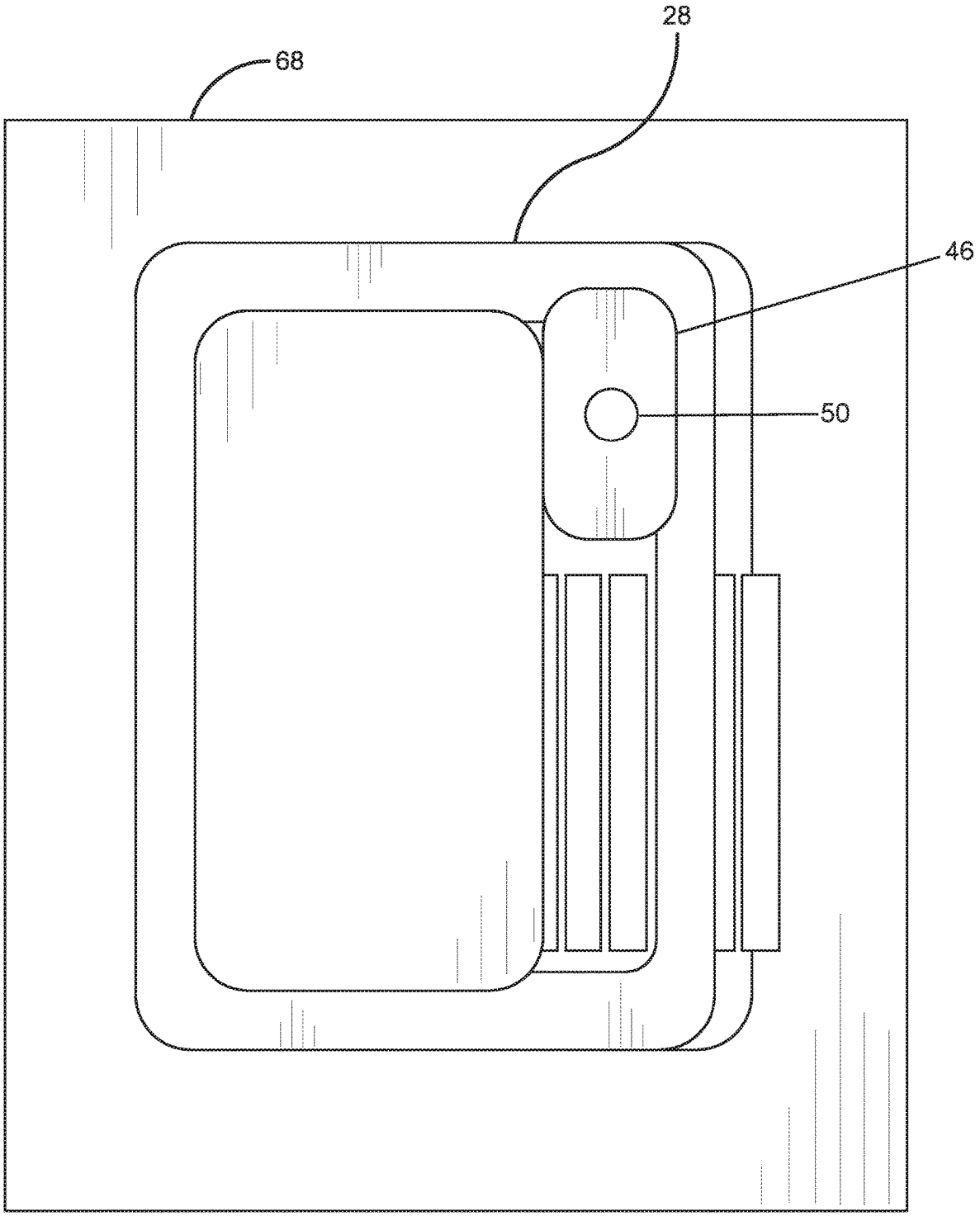

A useful aspect of the exemplary arrangement of components which comprise the refrigeration apparatus is that they may be packaged in one or more generally flat profile boxes and shipped unassembled to the destination. Specifically such generally flat boxes are rectangular in shape with much greater length and width dimensions than the thickness dimension. For example FIG. 2 shows transparently the inclusion of the enclosure panels 12 and the corner posts 14 within a flat box 64 Likewise FIG. 3 shows the cover panel 18, the base 52 and casters 60 within a flat box 66. FIG. 4 shows the platform 28 within a flat box 68. Of course as can be appreciated, suitable packing materials, separator sheets, spacers and other structures may be included within the flat boxes so as to hold the components in place and minimize the risk of damage during normal shipping and handling. Further it should be understood that while three separate boxes are shown as holding the components of the exemplary refrigeration apparatus, different numbers of boxes may be utilized in other arrangements.

In the exemplary embodiment the refrigeration apparatus 10 is ideally assembled at a site near where it will be utilized. For example, after unpacking the components, the assembly process may be started by engaging the casters 60 with the base 52. The platform 28 may be supported on the base 52 with the platform panel 30 disposed furthest away from the base and the evaporator 32 facing upward.

Once the platform 28 is supported on the base, the corner posts 14 may be engaged in the base pockets 58. Once each of the four corner posts 14 are engaged in a respective base pocket, the separable enclosure panels 12 may be slid downward between the corner posts such that the lower ends thereof engage the upward facing face of the platform panel 30. This forms the enclosure which generally bounds the interior area 15.

With the side panels in place, the corner posts 14 extend above the side panels such that the cover panel 18 may be engaged therewith. The cover panel is attached by engaging respective corner posts 14 in respective cover pockets 26. The panel joints 16 extend between the cover projections 24 and the corner posts 14. With the cover panel 18 installed, the refrigeration apparatus 10 can be connected to a power source and utilized for purposes of storing items at lower than ambient temperatures. As previously mentioned, the exemplary arrangement of refrigeration apparatus 10 is configured to be utilized as a freezer. However, in other arrangements, other types of uses may be carried out by structures of this type.

Further it should be understood that while in the exemplary embodiment the structure of the refrigeration apparatus includes an access door in a top panel. In other arrangements, other types of configurations may be utilized. For example in some arrangements the platform may be utilized as a side panel or back panel of the enclosure structure. In such arrangements, the access panel may be provided on a front surface opposite the platform or alternatively on a side surface or in a top panel surface. Various different configuration can be provided for refrigeration apparatus structures as is desired for the particular type of device desired.

Further in exemplary arrangements, the components may be assembled without the use of any tools or special skills. As can be appreciated, the exemplary arrangement provides for all the components to be assembled by sliding together without the need for fasteners. Of course as can be appreciated in some arrangements, fasteners may be utilized to hold components in engagement. However, in many arrangements the number and type and complexity of such fasteners may be minimal. Further as previously discussed, the use of barbs, hooks, ridges or other configurations in the adjacent structures can be utilized to provide a structure that is generally permanently engaged once the components have been assembled. Alternatively, in some exemplary embodiments the components may be held in fixed engagement by readily installed fasteners such as screws which can be installed with simple hand tools such as a screwdriver. Of course it should be understood that these approaches are exemplary and in other embodiments, other approaches may be used.

Thus the elements, features and characteristics of the embodiments described achieve desirable results, eliminate difficulties encountered in the use of prior devices and systems, solve problems and attain one or more useful objectives as stated above.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations given herein are by way of examples and the useful features are not limited to the exact details shown and described.

Further the descriptions which refer to left/right, top/bottom or similar terms indicating relative locations of items shall not be deemed limiting, and it will be understood that exemplary embodiments can be configured and used in numerous different orientations.

Having described the features, discoveries and principles of the exemplary embodiments, the manner in which they are constructed, operated and utilized, and the advantages and useful results attained, the new and useful structures, devices, elements, arrangements, parts, combinations, systems, equipment, operations, methods, processes and relationships are set forth in the appended claims.

I claim:

1. A refrigeration apparatus comprising:

a rectangular platform, wherein the platform includes a rectangular platform panel, wherein the platform panel extends horizontally and includes an upward facing face, a refrigerant evaporator, wherein the evaporator extends on an upper side of the platform panel, and wherein the upper side of the platform panel includes the upward facing face, a refrigerant compressor, a refrigerant condenser, wherein the compressor and condenser are in fluid connection with the evaporator and extend on a lower side of the platform panel, four separable enclosure panels, wherein each of the four enclosure panels is bounded by a respective lower end, wherein each lower end is in abutting engagement with the upward facing face, extends upward from the platform panel and is joined together with two other enclosure panels and the platform panel to bound a refrigerated interior area, wherein the abutting engagement of each lower end with the upward facing face of the platform panel bounds and closes the refrigerated interior area, which refrigerated interior area does not extend below the upward facing face.

2. The apparatus according to claim 1 wherein the platform includes a rectangular horizontal extending further panel, wherein the further panel is disposed downward from the platform panel, wherein the compressor and the condenser extend intermediate of the platform panel and the further panel.

3. The apparatus according to claim 2 and further including a fan in operative supported connection with the further panel, wherein the fan extends intermediate of the platform panel and the further panel, and causes air to flow between the platform panel and the further panel.

4. The apparatus according to claim 3 wherein the platform includes a power controller, wherein the power controller is in operative connection with the platform panel, extends on the upper side of the platform panel and includes a manually actuatable input device accessible in the interior area.

5. The apparatus according to claim 4 and further including a rectangular base, wherein the base supports the platform and the separable enclosure panels above the base.

6. The apparatus according to claim 5 and further including a plurality of casters, wherein each of the casters is removably mounted to the base.

7. The apparatus according to claim 5 and further including a plurality of corner posts, wherein each corner post includes a 90° L-shape angle structure, wherein each of the enclosure panels have vertically extending edges and when immediately adjacent enclosure panels are joined together, the edges of immediately adjacent enclosure panels are in continuous immediate adjacent relation at joints, wherein each corner post outwardly overlies and vertically spans a respective joint external of the interior area.

8. The apparatus according to claim 7 wherein the base includes a plurality of L-shape base pockets, wherein a respective L-shape corner post is engaged in a respective L-shape base pocket, and extends in an upward direction therefrom.

9. The apparatus according to claim 8 wherein the base includes four base corners, wherein the L-shape base pockets extend at each of the base corners.

10. The apparatus according to claim 9 wherein the platform is positioned within a platform area bounded by the corner posts when such posts are engaged with the base pockets, and wherein the platform is engaged with each of the corner posts wherein relative lateral movement of the platform and the base is prevented.

11. The apparatus according to claim 9 and further comprising:

a cover panel, wherein the cover panel includes a cover opening and a movable door configured to selectively open and close the cover opening, wherein the cover panel is in operative supported connection with the plurality of enclosure panels and bounds the interior area.

12. The apparatus according to claim 11 wherein the cover panel is disposed on a top side of the interior area generally opposite of the upper side of the platform panel.

13. The apparatus according to claim 12
wherein the cover panel includes a plurality of cover projections, wherein each cover projection inwardly overlies a respective joint within the interior area.

14. The apparatus according to claim 13
wherein the cover panel includes four cover projections, wherein at least one enclosure panel extends between a respective corner post and a respective cover projection.

15. The apparatus according to claim 14
wherein each of two immediately adjacent enclosure panels at a respective joint extend in contact with and in sandwiched transverse relation between, each respective corner post and each respective cover projection.

16. The apparatus according to claim 13
wherein the cover panel includes a plurality of cover pockets, each including an L-shape aperture wherein a respective L-shape corner post is engaged in a respective L-shape aperture of such cover pocket.

17. The apparatus according to claim 16
wherein a respective joint and each of two enclosure panels in immediately adjacent relation at such joint, extend in sandwiched relation transversely between a respective cover projection and a respective L-shape corner post engaged in a cover pocket.

18. The apparatus according to claim 17, and further comprising:
at least one generally flat box,
wherein all of the plurality of enclosure panels, the platform, the base, the corner posts and the cover panel are releasably engageable and are configured to be housed when unassembled in the at least one generally flat box.

19. The apparatus according to claim 1 and further comprising:
at least one flat box,
wherein all of the plurality of enclosure panels and the platform are releasably engageable and are configured to be housed when unassembled in the at least one flat box.

20. A refrigeration apparatus comprising:
a base,
a platform, wherein the platform extends horizontally and is operatively supported by the base, wherein the platform includes a horizontally extending upper side with a Peltier device in operatively supported connection with the horizontally extending upper side, wherein the upper side includes a horizontally extending upward facing face,
a cover panel, wherein the cover panel extends parallel to the upward facing face,
a plurality of enclosure panels, wherein each of the enclosure panels is in directly contacting engaged relation with the upward facing face and extends upward from the upper side to the cover panel,
wherein the base, the plurality of enclosure panels, the platform and the cover panel are joined in fixed assembled relation such that the platform is laterally immovable relative to the enclosure panels, and the upper side, the plurality of enclosure panels and the cover panel directly bound a refrigerated interior area, and
wherein the cover panel is supported by the plurality of enclosure panels and is in fixed operative connection with the enclosure panels on a top side of the interior area generally opposite of the platform.

21. A refrigeration apparatus comprising:
a base,
a platform, wherein the platform is operatively supported by the base,
wherein the platform includes an upper side, wherein the upper side includes an evaporator or an electronic cooling device,
a cover panel,
four enclosure panels, wherein each enclosure panel is positioned at 90° to two immediately adjacent enclosure panels,
wherein the four enclosure panels extend vertically from the platform upper side to the cover panel, and wherein the four enclosure panels, the cover panel and the upper side bound a refrigerated interior area, which refrigerated interior area does not extend below the upper side,
wherein each enclosure panel is bounded laterally by two vertically extending edges, each of which edges extend vertically continuously between the upper side and the cover panel in immediately adjacent relation with an edge of an immediately adjacent enclosure panel to form a respective joint,
four corner posts, wherein each corner post comprises a 90° L-shape angle structure,
wherein the base includes four L-shape base pockets,
wherein the cover includes four L-shape cover pockets,
wherein each respective corner post extends vertically in a respective base pocket and in a respective cover pocket and spans a respective joint in outwardly overlying relation.

22. The apparatus according to claim 21
wherein the cover includes four cover projections,
wherein each cover projection inwardly underlies a respective joint, and wherein two enclosure panels extend in sandwiched contacting relation transversely between a respective cover projection and a respective corner post.

23. The apparatus according to claim 21
wherein the four enclosure panels bound a platform area, and the platform is engaged with each of the corner posts, wherein relative lateral movement of the platform and the base is prevented.

24. The apparatus according to claim 21
wherein the platform upper side includes an upward facing face,
wherein each of the enclosure panels is in abutting relation with the upward facing face and extends upward therefrom.

25. The apparatus according to claim 21
wherein the platform includes a platform panel and a further panel, wherein the further panel is vertically disposed below the platform panel, and wherein a space extends between the platform panel and the further panel,
wherein the platform panel includes the upper side and the evaporator is operatively supported on the upper side,
and further including
a fan,
a compressor, and
a condenser,
wherein the compressor and the condenser are in fluid connection with the evaporator,
wherein the compressor and the condenser extend below the platform panel and above the further panel,
wherein the fan is operative to move air in the space between the platform panel and the further panel.

26. The apparatus according to claim 21 wherein the cover panel includes a cover opening and a movable door configured to selectively open and close the cover opening, and further comprising a plurality of casters, each of which casters is releasably engageable with the base.

27. A refrigeration apparatus comprising:

a platform, wherein the platform includes a horizontally extending upper side, wherein a Peltier device is operatively supported on the horizontally extending upper side, a cover panel, a plurality of enclosure panels, wherein each of the enclosure panels includes a respective bottom side and a respective top side, wherein each bottom side is in directly contacting engaged relation with the platform and each enclosure panel extends upward therefrom, wherein the cover panel is supported by the top side of each of the enclosure panels and is in fixed operative connection therewith, wherein the cover panel extends above and in generally opposed relation of the platform, wherein the plurality of enclosure panels, the platform, and the cover panel are joined in fixed laterally immovable relation such that the horizontally extending upper side, the plurality of enclosure panels, and the cover panel directly bound a closed refrigerated interior area.

* * * * *